US010167878B2

(12) United States Patent
Cruz et al.

(10) Patent No.: US 10,167,878 B2
(45) **Date of Patent: *Jan. 1, 2019**

(54) COOLING FAN COUPLED WITH A SET OF RECIRCULATION FLAPS

(71) Applicant: International Business Machines Corporation, Armonk, NY (US)

(72) Inventors: Ethan E. Cruz, LaGrangeville, NY (US); Jose A. Hejase, Austin, TX (US); Howard V. Mahaney, Jr., Cedar Park, TX (US); Joel Mendez, Baytown, TX (US)

(73) Assignee: International Business Machines Corporation, Armonk, NY (US)

( * ) Notice: Subject to any disclaimer, the term of this patent is extended or adjusted under 35 U.S.C. 154(b) by 443 days.

This patent is subject to a terminal disclaimer.

(21) Appl. No.: 14/935,663

(22) Filed: Nov. 9, 2015

(65) Prior Publication Data

US 2017/0130734 A1 May 11, 2017

(51) Int. Cl.
*F04D 29/52* (2006.01)
*F04D 19/00* (2006.01)
(Continued)

(52) U.S. Cl.
CPC ..... *F04D 29/524* (2013.01); *F04D 19/002* (2013.01); *F04D 25/08* (2013.01);
(Continued)

(58) Field of Classification Search
CPC .. F04D 29/524; F04D 29/644; F04D 29/5813; F04D 29/541; F04D 27/009;
(Continued)

(56) References Cited

U.S. PATENT DOCUMENTS 6,031,717 A 2/2000 Baddour et al.
6,174,232 B1 1/2001 Stoll et al.
(Continued)

FOREIGN PATENT DOCUMENTS

JP 06310887 A 11/1994
KR 1020130073062 A 7/2013

OTHER PUBLICATIONS

Cruz et al., "Cooling Fan Coupled With a Set of Recirculation Flaps", U.S. Appl. No. 15/049,031, filed Feb. 20, 2016.
List of IBM Patents or Patent Applications Treated as Related.

*Primary Examiner* — Sarang Afzali
(74) *Attorney, Agent, or Firm* — Ulysses Williams, III

(57) ABSTRACT

Disclosed aspects relate to cooling electronics. A set of recirculation flaps is coupled with a cooling fan. At least one recirculation flap has a ferrous material. In various embodiments, the set of recirculation flaps is arranged in an open position in response to air pressure from the cooling fan, and is arranged in a closed position in response to substantially no air pressure from the cooling fan. A controller is coupled with the cooling fan. The controller indicates a set of indicated positions for the set of recirculation flaps based on a tachometer value. An electromagnet is connected with the controller to position the set of recirculation flaps in the set of indicated positions using the ferrous material. In various embodiments, the electromagnet engages the ferrous material to arrange the set of recirculation flaps in an open position.

10 Claims, 10 Drawing Sheets

(51) Int. Cl.

| | |
|---|---|
| ***F04D 29/58*** | (2006.01) |
| ***F04D 27/00*** | (2006.01) |
| ***F04D 29/02*** | (2006.01) |
| ***F04D 25/08*** | (2006.01) |
| ***F04D 29/54*** | (2006.01) |
| ***F04D 29/64*** | (2006.01) |

(52) U.S. Cl.
CPC ..... *F04D 27/001* (2013.01); *F04D 27/009* (2013.01); *F04D 29/023* (2013.01); *F04D 29/541* (2013.01); *F04D 29/582* (2013.01); *F04D 29/5813* (2013.01); *F04D 29/644* (2013.01); *Y10T 29/49327* (2015.01); *Y10T 29/49329* (2015.01)

(58) Field of Classification Search
CPC ..... F04D 19/002; F04D 25/08; F04D 29/023; F04D 27/001; F04D 29/582; F04D 29/14; F04D 29/08; H05K 7/20136; H05K 7/20181; H05K 7/20209; H05K 7/20554–7/2059; H05K 7/20718–7/20745; H05K 7/20618; Y10T 29/49245; Y10T 29/49327; Y10T 29/49329
See application file for complete search history.

(56) References Cited

U.S. PATENT DOCUMENTS

| | | | | |
|---|---|---|---|---|
| 6,880,799 | B2 * | 4/2005 | Mrozek | F24F 11/0086 251/129.12 |
| 7,345,875 | B2 | 3/2008 | Elkins | |
| 7,416,481 | B2 | 8/2008 | Baker et al. | |
| 7,800,902 | B2 | 9/2010 | Della Fiora et al. | |
| 8,388,423 | B2 | 3/2013 | Cruz et al. | |
| 8,414,368 | B2 * | 4/2013 | Hansen | F04D 25/14 137/512.1 |
| 8,601,740 | B2 | 12/2013 | Tu et al. | |
| 8,897,009 | B2 | 11/2014 | Janes et al. | |
| 2011/0259550 | A1 | 10/2011 | Komaba et al. | |
| 2017/0111521 | A1 * | 4/2017 | Bowers et al. | H04M 17/026 |

* cited by examiner

COOLING FAN COUPLED WITH A SET OF RECIRCULATION FLAPS

BACKGROUND

This disclosure relates generally to cooling systems for electronics and, more particularly, relates to a cooling fan coupled with a set of recirculation flaps. One aspect of thermally managing and maintaining electronic systems involves properly cooling equipment to provide for reliability and proper performance. Properly cooling equipment may include generating airflow to remove heat generated by the equipment and maintain the temperature of various components within a suitable operating range. Air moving in substantially parallel airflow paths impelled by air moving devices such as fans can cool the components.

SUMMARY

Aspects of the disclosure relate to cooling electronics. A set of recirculation flaps is coupled with a cooling fan. In embodiments, airflow is substantially unimpeded with respect to the set of recirculation flaps coupled with the cooling fan. At least one recirculation flap has a ferrous material. In various embodiments, the set of recirculation flaps is arranged in an open position in response to air pressure from the cooling fan, and is arranged in a closed position in response to substantially no air pressure from the cooling fan.

A controller is coupled with the cooling fan. The controller indicates a set of indicated positions for the set of recirculation flaps based on a tachometer value. An electromagnet is connected with the controller to position the set of recirculation flaps in the set of indicated positions using the ferrous material. In various embodiments, the electromagnet engages the ferrous material to arrange the set of recirculation flaps in an open position.

The above summary is not intended to describe each illustrated embodiment or every implementation of the present disclosure.

BRIEF DESCRIPTION OF THE SEVERAL VIEWS OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
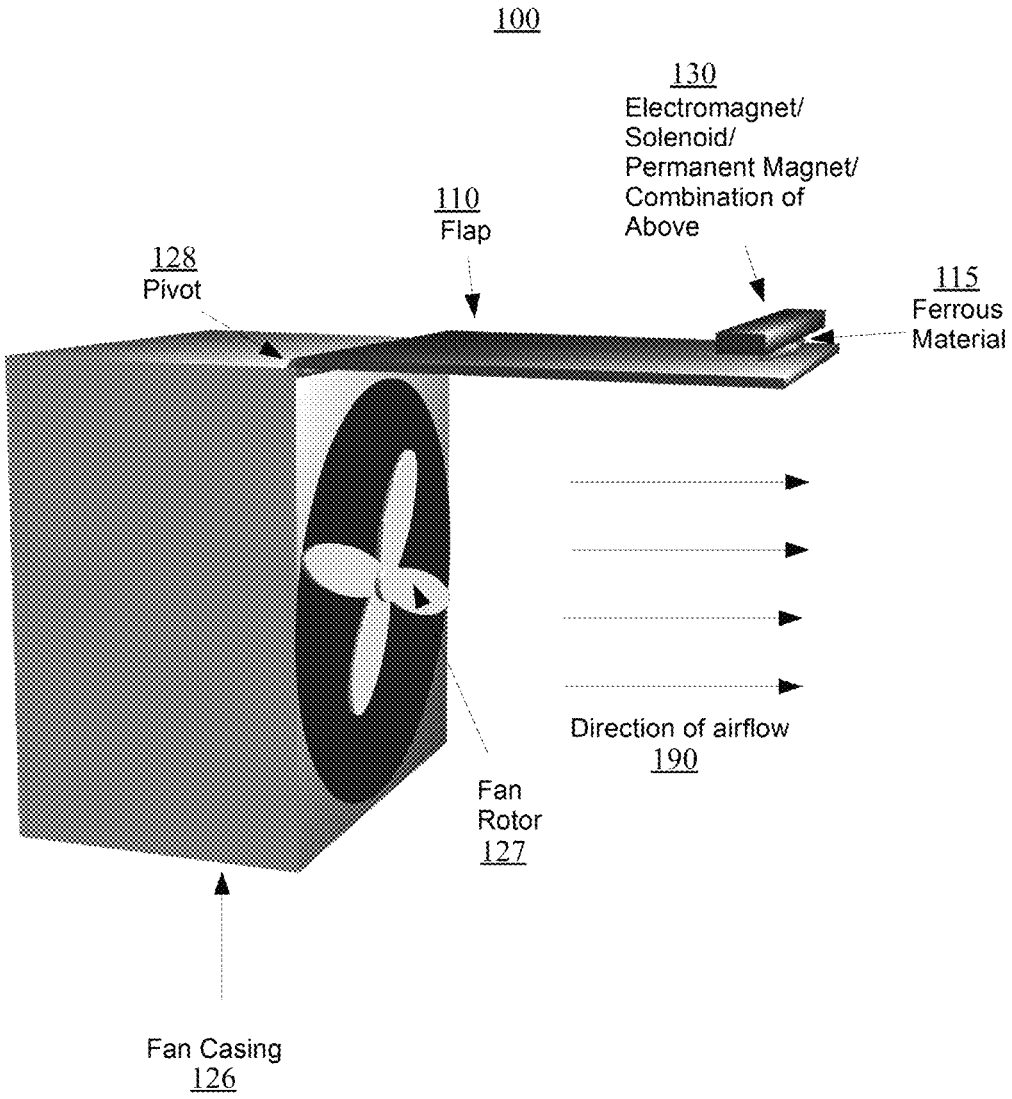
FIG. 1 is a diagrammatic illustration of a cooling apparatus, according to embodiments.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Aspects of the disclosure include an electromagnet, solenoid, permanent magnet, or a combination of such to hold open a set of recirculation flaps with power consumption below a threshold. The impedance generated by recirculation devices may be due to the pressure required to keep them open during operation. This can include a significant amount of power that is converted from electrical power into mechanical power in the cooling fan in the form of pressure (which keeps the set of recirculation flaps open/extended). Aspects of the disclosure may have positive impacts on both airflow and power consumption when compared to other recirculation devices.

Accordingly, elements described herein include a low airflow impedance anti-recirculation device. An air circulation device can be provided with a fan that is equipped with a hinged flap (e.g., which is placed on a side of the fan internal to an enclosure). When operational, the air from the fan opens the flap and an electromagnet may keep the flap in the open position (even if/when the air flow is reduced). For example, when power is turned on, the fan speed can be set above a threshold (e.g., to a maximum level) and power is enabled in an electromagnet. The airflow from the (maxed-out) fan raises the flap to the electromagnet which holds the flap up, including holding the flap up when the fan speed is reduced to a level appropriate for a current thermal environment. As such, airflow may be less impeded by the flap (which is held up electromagnetically).

Aspects may also allow for fan failure redundancy while providing a substantially similar level of airflow relative to those without such a feature. Redundancy may be built into information technology equipment in order to improve operational reliability. In particular, this can be the case for cooling systems where rotating machinery wear out over time. However, due to the relatively high impedance of current anti-recirculation devices, recent air cooled systems may have redundancy features removed in order to allow for higher performance. In these latest systems if a high performance counter-rotating fan fails, then the entire system may be almost immediately shutdown.

Aspects of the disclosure include an apparatus, a system, and a method which relate to cooling electronics. A set of recirculation flaps is coupled with a cooling fan. In embodiments, airflow is substantially unimpeded with respect to the set of recirculation flaps coupled with the cooling fan. At least one recirculation flap has a ferrous material. In various embodiments, the set of recirculation flaps is arranged in an open position in response to air pressure from the cooling fan, and is arranged in a closed position in response to substantially no air pressure from the cooling fan. Accordingly, the closed position may allow substantially no airflow (to prevent reverse airflow through the cooling fan).

A controller is coupled with the cooling fan. The controller indicates a set of indicated positions for the set of recirculation flaps based on a tachometer value. In embodiments, the controller includes both a fan speed controller and a recirculation flap controller. The fan speed controller may configure a fan speed which correlates with the tachometer value. The recirculation flap controller may arrange the set of recirculation flaps in an open position when the tachometer value exceeds a threshold and in a closed position when the tachometer value does not exceed the threshold.

An electromagnet is connected with the controller to position the set of recirculation flaps in the set of indicated positions using the ferrous material. In embodiments, the electromagnet includes a solenoid. In various embodiments, the electromagnet engages the ferrous material to arrange the set of recirculation flaps in an open position. In certain embodiments, the electromagnet maintains the set of recirculation flaps in the open position without use of air pressure from the cooling fan. In various embodiments, a permanent magnet neighbors the electromagnet to position the set of recirculation flaps in the set of indicated positions using the ferrous material in conjunction with the electromagnet. In certain embodiments, the electromagnet disengages the ferrous material from the permanent magnet to arrange the set of recirculation flaps in a closed position.

Aspects of the disclosure may have performance or efficiency benefits (e.g., airflow impedance, power consumption). In embodiments, the electromagnet uses less than 0.1 watts to position the set of recirculation flaps. For example, the electromagnet may use less than 0.1 watts to position the set of recirculation flaps when a fan size is 80×80 millimeters. In various embodiments, the electromagnet can use less than two percent (2%) of a cooling fan power to position the set of recirculation flaps (e.g., when the fan size is greater than 38 millimeters). As such, the electromagnet power may be negligible in comparison to the (maximum) power of the cooling fan.

FIG. 1 is a diagrammatic illustration of a cooling apparatus 100, according to embodiments. A fan rotor 127 may be enclosed by a fan casing 126. A recirculation flap 110 may be attached to the fan casing 126 at a pivot 128. The recirculation flap 110 may have a ferrous material 115 (e.g., iron, iron alloy) attached. When in an open position which allows airflow 190 from the fan rotor 127, the ferrous material 115 may be used to position the recirculation flap 110 as such by the electromagnet 130 (e.g., solenoid or with a permanent magnet or a combination thereof).

Figure 2:
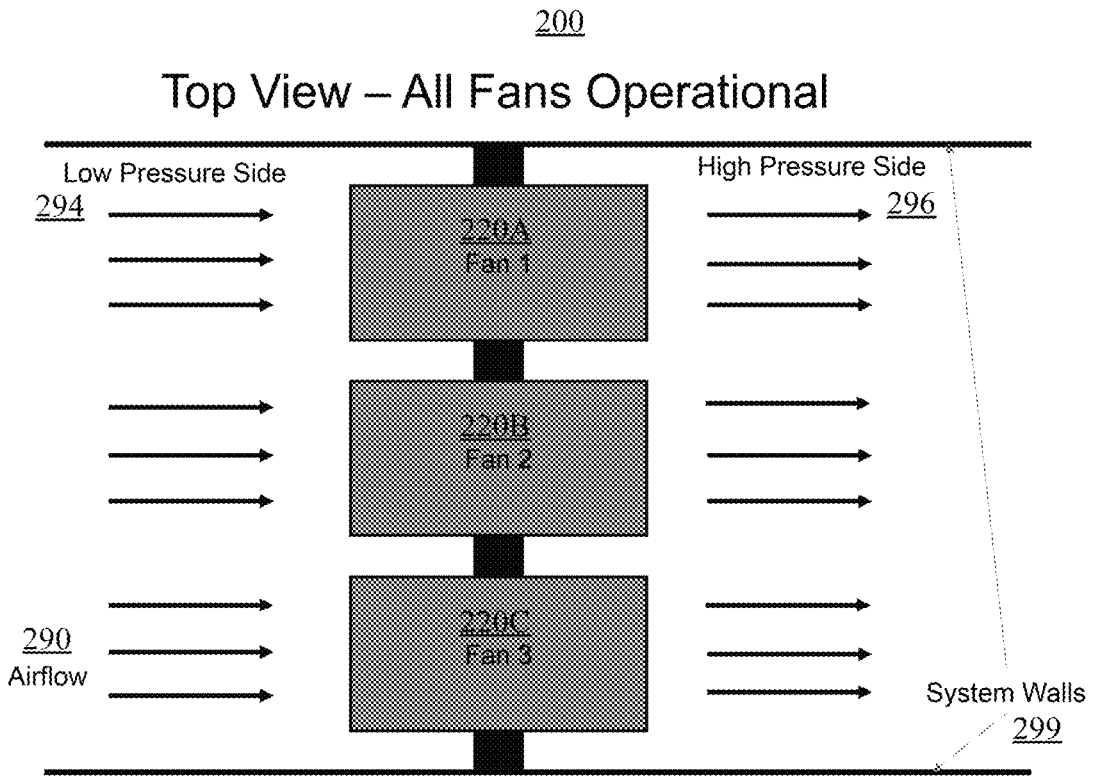
FIG. 2 is a top view illustration of a cooling system.

FIG. 2 is a top view illustration of a cooling system 200. The cooling system 200 may include a set of fans 220A, 220B, and 220C within system walls 299. Airflow 290 may have a low pressure side 294 before entering the set of fans and a high pressure side 296 after exiting the set of fans. The cooling system 200 may represent an arrangement/configuration where the set of fans are operational.

Figure 3:
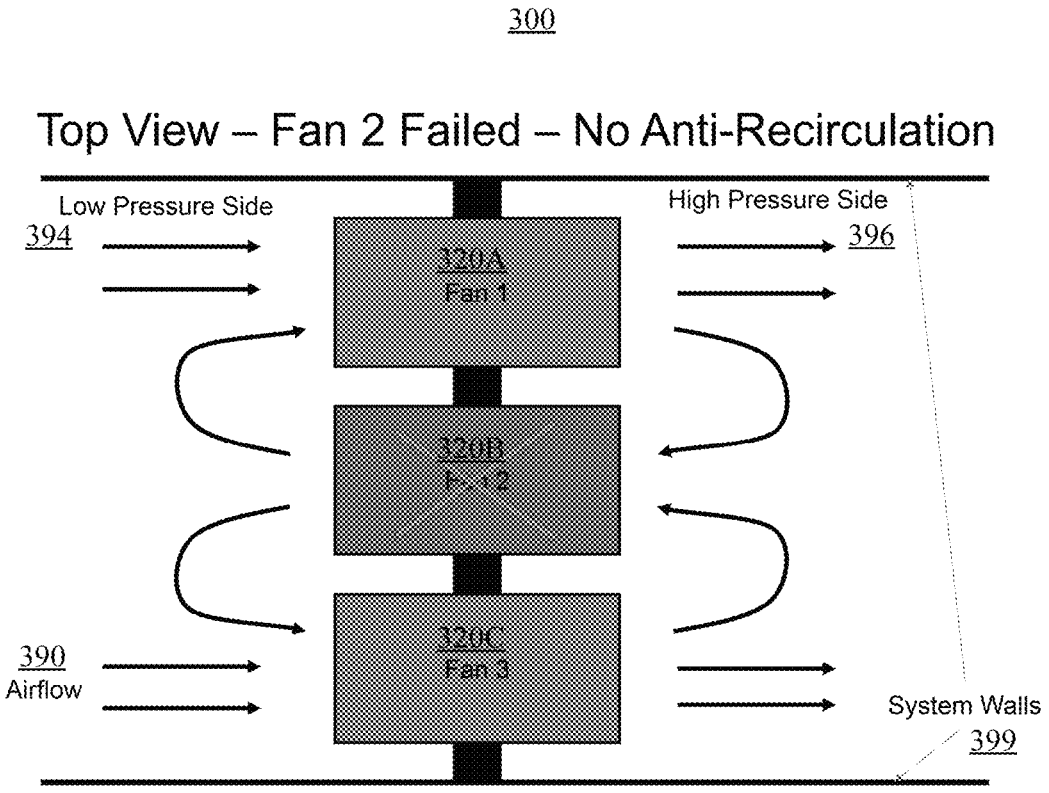
FIG. 3 is a top view illustration of a cooling system.

FIG. 3 is a top view illustration of a cooling system 300. The cooling system 300 may include a set of fans 320A, 320B, and 320C within system walls 399. Airflow 390 may have a low pressure side 394 before entering the set of fans and a high pressure side 396 after exiting the set of fans. The cooling system 300 may represent an arrangement/configuration where fans 320A and 320C are operational but fan 320B has failed. As such, recirculation challenges may be present with respect to airflow 390.

Figure 4:
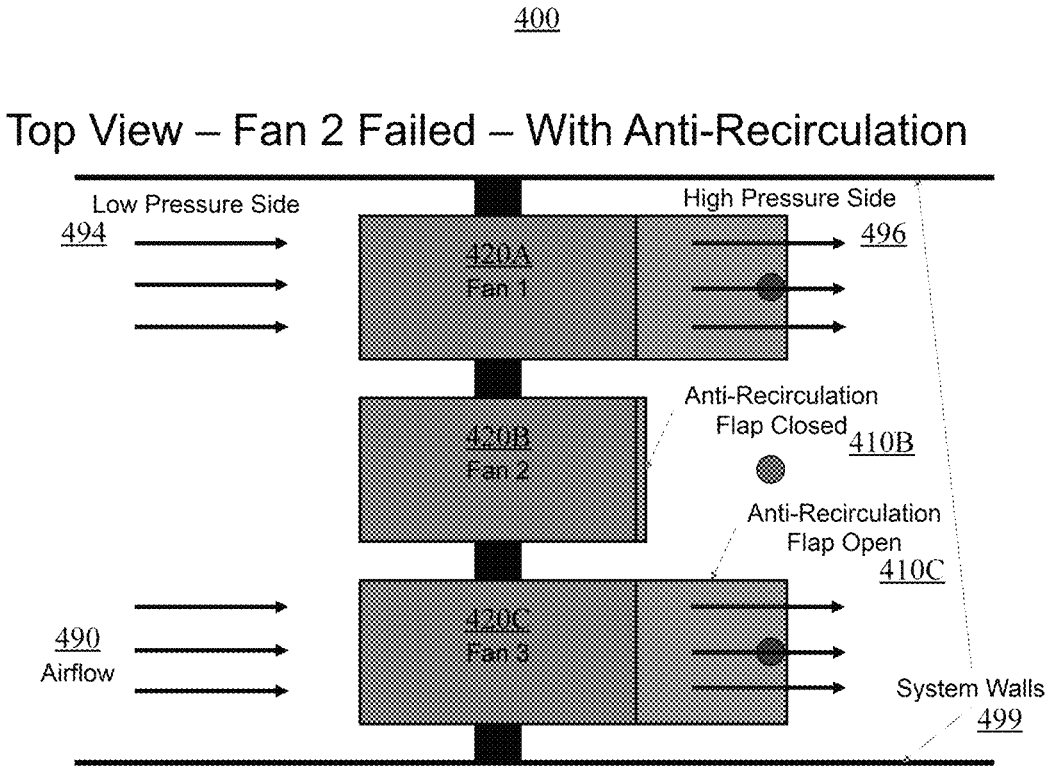
FIG. 4 is a top view illustration of a cooling system, according to embodiments.

FIG. 4 is a top view illustration of a cooling system 400, according to embodiments. The cooling system 400 may include a set of fans 420A, 420B, and 420C within system walls 499. Airflow 490 may have a low pressure side 494 before entering the set of fans and a high pressure side 496 after exiting the set of fans. The cooling system 400 may represent an arrangement/configuration where fans 420A and 420C are operational but fan 420B is not operational (e.g., has failed). To illustrate aspects described herein, a recirculation flap 410A (or 410C) coupled with the fan 420A (or 420C) may be in an open position while a recirculation flap 410B coupled with the fan 420B may be in a closed position. As such, recirculation challenges may be alleviated with respect to airflow 490 relative to airflow 390 in FIG. 3 (e.g., by streamlining airflow to continue/proceed on its normal/natural/traditional/typical path as in FIG. 2 and airflow 290). FIGS. 2/3/4 illustrate three fans; however, a plurality of fans such as twelve, twenty, or fifty may be used, for example.

Figure 5:
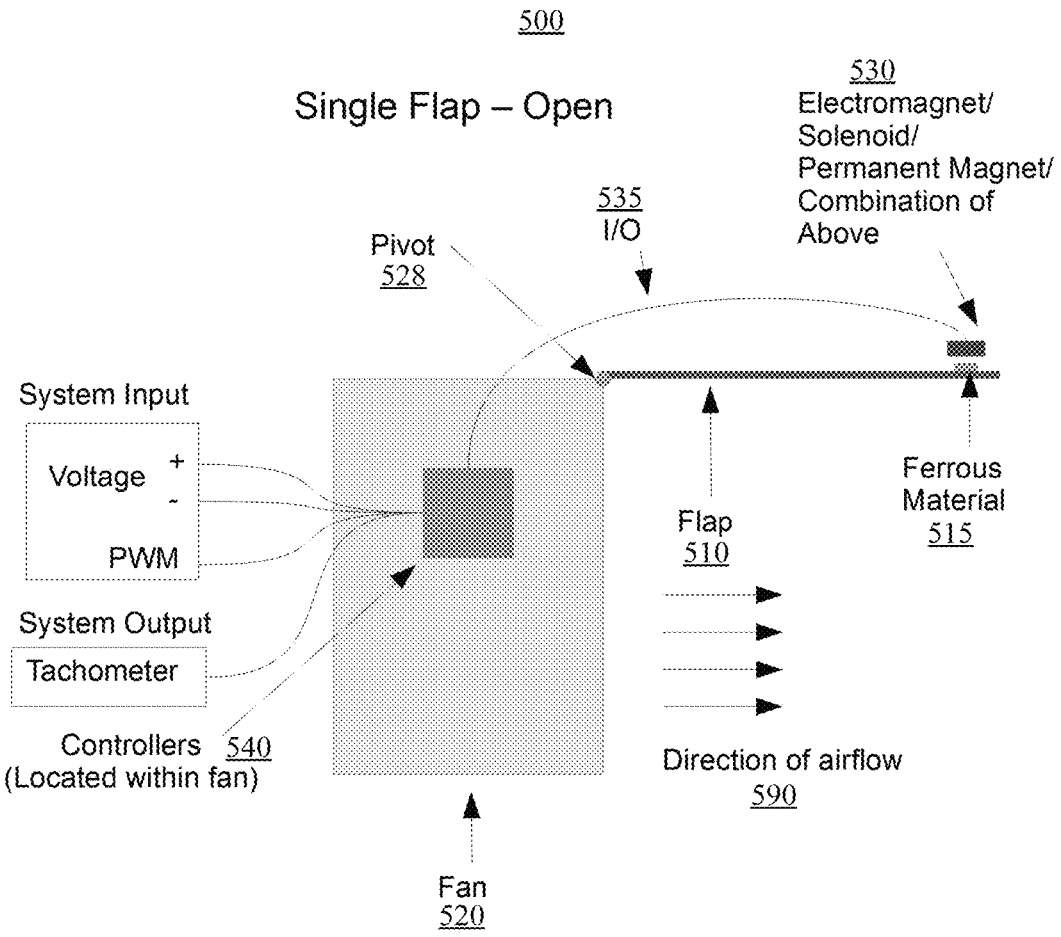
FIG. 5 is a side view illustration of a single-flap cooling apparatus, according to embodiments.

FIG. 5 is a side view illustration of a single-flap cooling apparatus 500, according to embodiments. Flap 510 represents a set of recirculation flaps coupled with a cooling fan 520 using a pivot 528 in an open position. The flap 510 has a ferrous material 515 (or a similar material compatible with usage of the electromagnet as described herein). A controller 540 is coupled with the cooling fan 520. For example, the controller 540 may be located inside or outside of the cooling fan 520. As depicted in FIG. 5, the controller 540 indicates an open position for the flap 510 based on a tachometer value (e.g., a value which indicates that the fan is operating correctly, a value which exceeds a threshold) with airflow 590 moving through the cooling fan 520.

An electromagnet 530 may be connected with the controller 540 via a transmission/signal carrier (e.g., input/output wire 535) to position the flap 510 in the open position using the ferrous material 515. The electromagnet/solenoid/permanent magnet/combination 530 can hold the flap 510 open during fan operation thereby having a positive impact with respect to the impedance and pressure work done by a cooling apparatus without such feature. The flap 510 can be held open by the electromagnet 530 using one or more solenoids.

A calculated power to perform the holding operation for an electromagnet for an 80 millimeter fan may be on the order of 0.1 Watts. The calculated power may be less than the power consumed by a cooling apparatus without such feature. In order to get the flap 510 to latch with the electromagnet/solenoid/permanent magnet/combination 530, the fan may first be run to a speed which exceeds a threshold (e.g., full speed) to open the flap 510. This may take a relatively short amount of time (e.g., only a few seconds) before the latching device (e.g., electromagnet 530) can be activated and then the cooling fan 520 can be set to a regular operating speed. In embodiments, a permanent magnet may be used in conjunction with the electromagnet 530 to provide additional holding force and reduce the force needed from the active devices. Using the permanent magnet could also have positive impacts on the (constant) power draw from the electromagnet.

Figure 6:
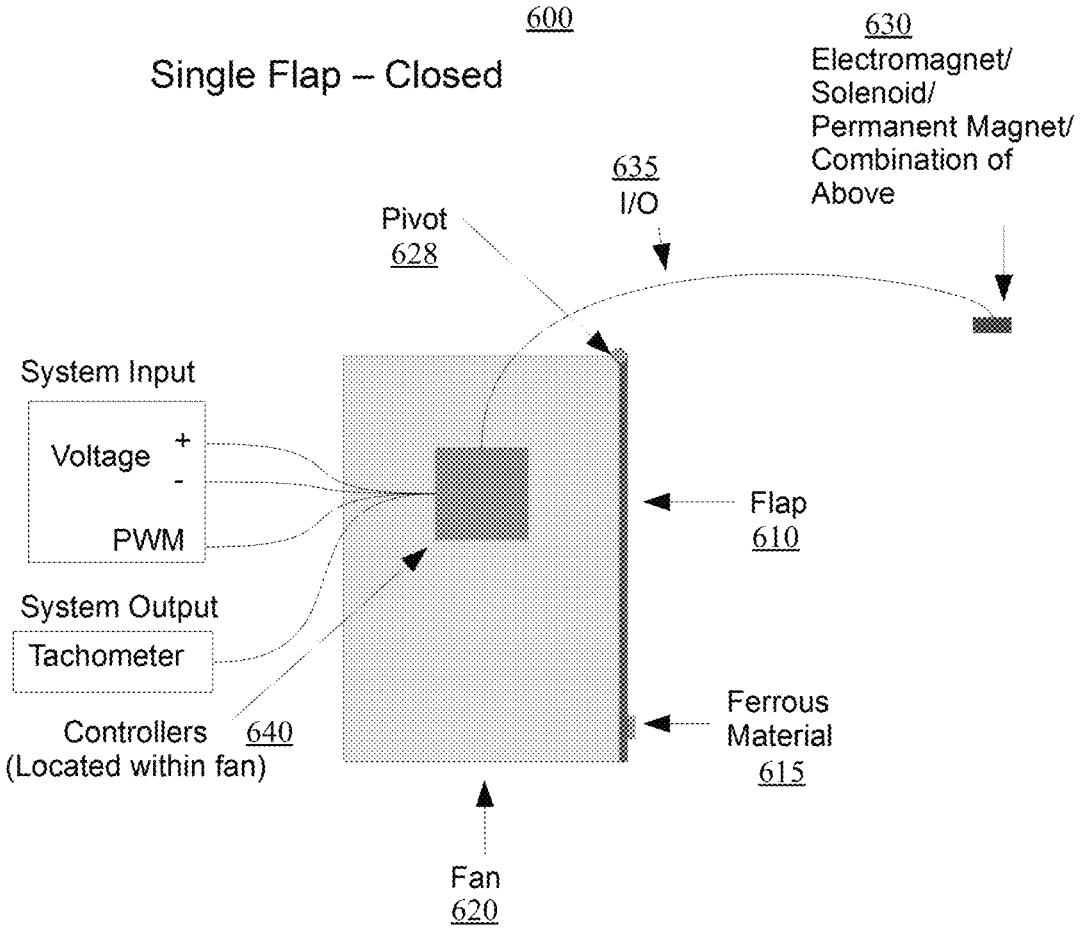
FIG. 6 is a side view illustration of a single-flap cooling apparatus, according to embodiments.

FIG. 6 is a side view illustration of a single-flap cooling apparatus 600, according to embodiments. Flap 610 represents a single-flap coupled with a cooling fan 620 using a pivot 628 in a closed position. The flap 610 has a ferrous material 615 (or a similar material compatible with usage of the electromagnet as described herein). A controller 640 is coupled with the cooling fan 620. For example, the controller 640 may be located inside or outside of the cooling fan 620. As depicted in FIG. 6, the controller 640 indicates a closed position for the flap 610 based on a tachometer value (e.g., a value which indicates that the fan is not spinning, a value which does not exceed a threshold). As such, airflow is generally not moving through the cooling fan 620.

An electromagnet 630 may be connected with the controller 640 via a transmission/signal carrier (e.g., input/ output wire 635) to position the flap 610 in the closed position by not using the ferrous material 615 to be latched (e.g., the closed position may be initiated by no longer attracting the ferrous material 615 with respect to the electromagnet 630 to unlatch the flap 610). In embodiments, a permanent magnet may hold the flap 610 open and an electromagnet can be used to push the flap 610 far enough away from the permanent magnet that the flap 610 is positioned in the closed position of FIG. 6. Such an embodiment may require power when disengaging the flap 610; however, if the controller 640 were to fail, then the cooling apparatus would be in the open position (as in FIG. 5) rather than the closed position (as in FIG. 6).

Figure 7:
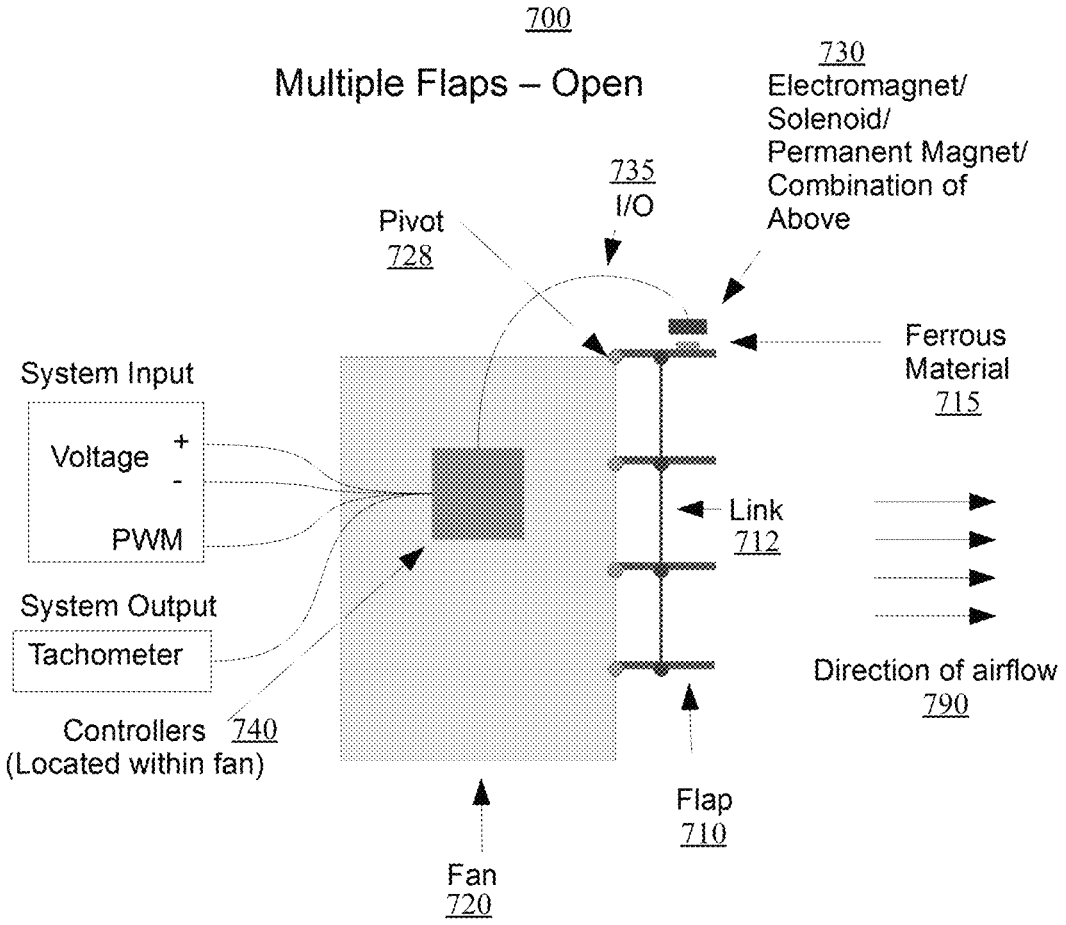
FIG. 7 is a side view illustration of a multiple-flap cooling apparatus, according to embodiments.

FIG. 7 is a side view illustration of a multiple-flap cooling apparatus 700, according to embodiments. Flap 710 represents a set of recirculation flaps coupled with a cooling fan 720 using a pivot 728 in an open position. The flap 710 has a ferrous material 715 (or a similar material compatible with usage of the electromagnet as described herein). Flap 710 may include a link 712 (e.g., a physical linkage) which links portions of the flap (e.g., in certain embodiments each portion may be considered a flap of the set of flaps). As such, the flap 710 may be made up of multiple flaps. The additional flaps may positively impact the size requirement in the airflow direction of the recirculation device. To illustrate, compare FIG. 5 and FIG. 7; the cooling apparatus 700 depicted in FIG. 7 requires less space in the direction of airflow 790 (e.g., roughly one-fourth as depicted with four flaps because the flap 510 in FIG. 5 is one structural flap that extends the height of the cooling fan 520).

A controller 740 is coupled with the cooling fan 720. For example, the controller 740 may be located inside or outside of the cooling fan 720. As depicted in FIG. 7, the controller 740 indicates an open position for the flap 710 based on a tachometer value (e.g., a value which indicates that the fan is operating correctly, a value which exceeds a threshold) with airflow 790 moving through the cooling fan 720. An electromagnet 730 may be connected with the controller 740 via a transmission/signal carrier (e.g., input/output wire 735) to position the flap 710 in the open position using the ferrous material 715. The electromagnet/solenoid/permanent magnet/combination 730 can hold the flap 710 open during fan operation thereby having a positive impact with respect to the impedance and pressure work done by a cooling apparatus without such feature.

Figure 8:
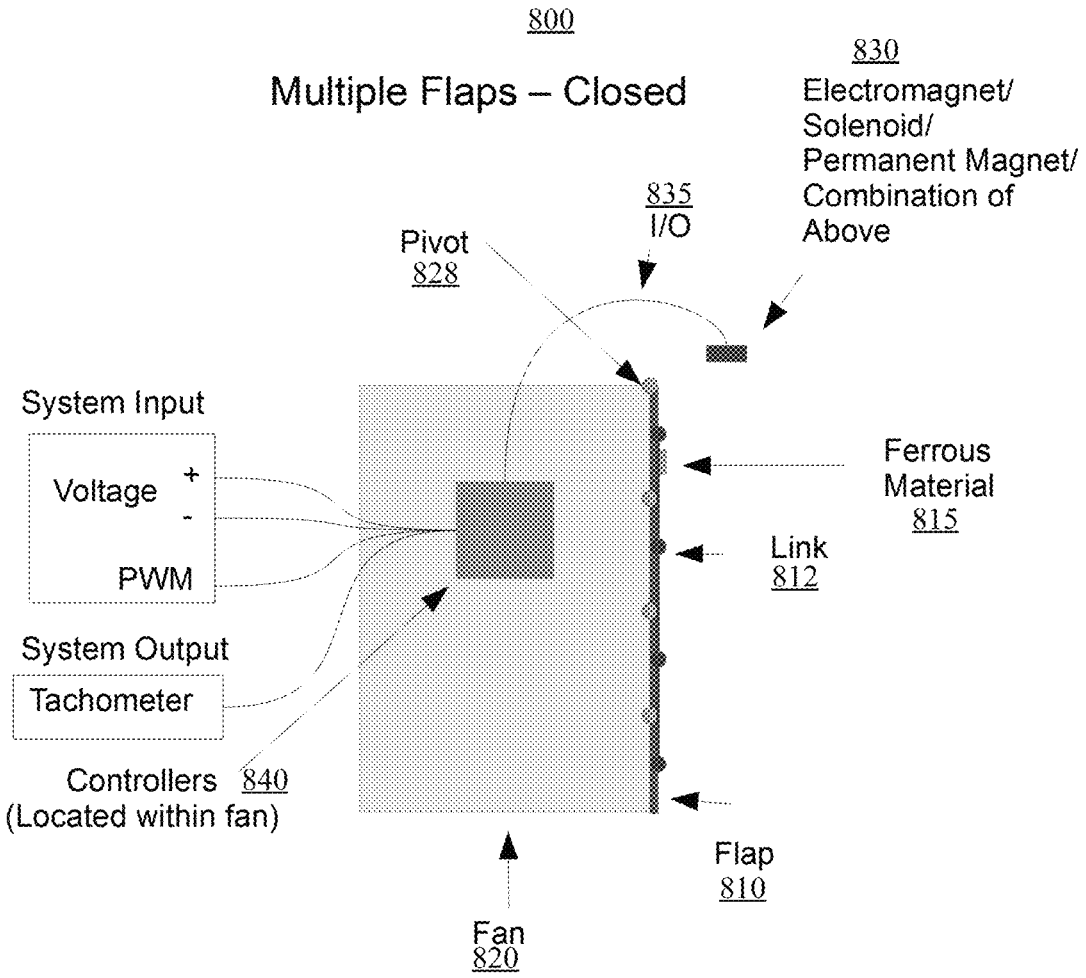
FIG. 8 is a side view illustration of a multiple-flap cooling apparatus, according to embodiments.

FIG. 8 is a side view illustration of a multiple-flap cooling apparatus, according to embodiments. Flap 810 represents a set of recirculation flaps coupled with a cooling fan 820 using a pivot 828 in a closed position. The flap 810 has a ferrous material 815 (or a similar material compatible with usage of the electromagnet as described herein). Flap 810 may include a link 812 (e.g., a physical linkage) which links portions of the flap (e.g., in certain embodiments each portion may be considered a flap of the set of flaps). As such, the flap 810 may be made up of multiple flaps.

A controller 840 is coupled with the cooling fan 820. For example, the controller 840 may be located inside or outside of the cooling fan 820. As depicted in FIG. 8, the controller 840 indicates a closed position for the flap 810 based on a tachometer value (e.g., a value which indicates that the fan is not spinning, a value which does not exceed a threshold). As such, airflow is generally not moving through the cooling fan 820. An electromagnet 830 may be connected with the controller 840 via a transmission/signal carrier (e.g., input/output wire 835) to position the flap 810 (e.g., multiple flaps) in the closed position by not using the ferrous material 815 to be latched.

Figure 9:
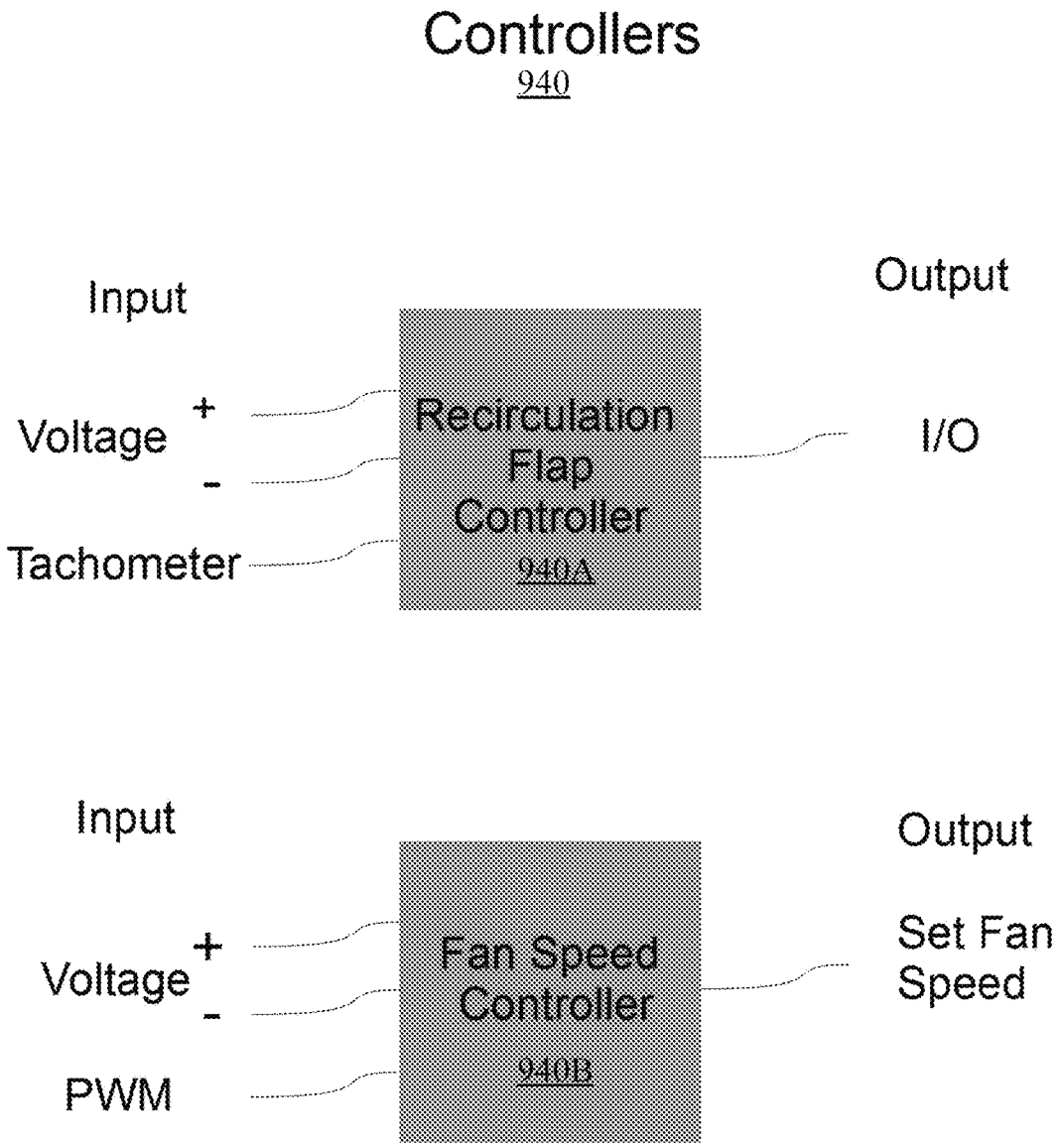
FIG. 9 is a diagrammatic illustration of a set of controllers for a cooling apparatus, according to embodiments.

FIG. 9 is a diagrammatic illustration of a set of controllers 940 for a cooling apparatus, according to embodiments. A controller may be used to hold the recirculation flap open during normal/regular operation, and close the flap during a fan failure. The recirculation flap controller 940A monitors a tachometer value/signal (e.g., a measurement of rotation speed or the like, via pulse-width modulation) from a fan speed controller 940B and activates the latch when the tachometer indicates that the fan is operating correctly. If/when the tachometer indicates that the fan is no longer spinning or spinning below a threshold, then the recirculation flap controller 940A unlatches the flap (e.g., by sending a signal) and the recirculation flap closes.

Figure 10:
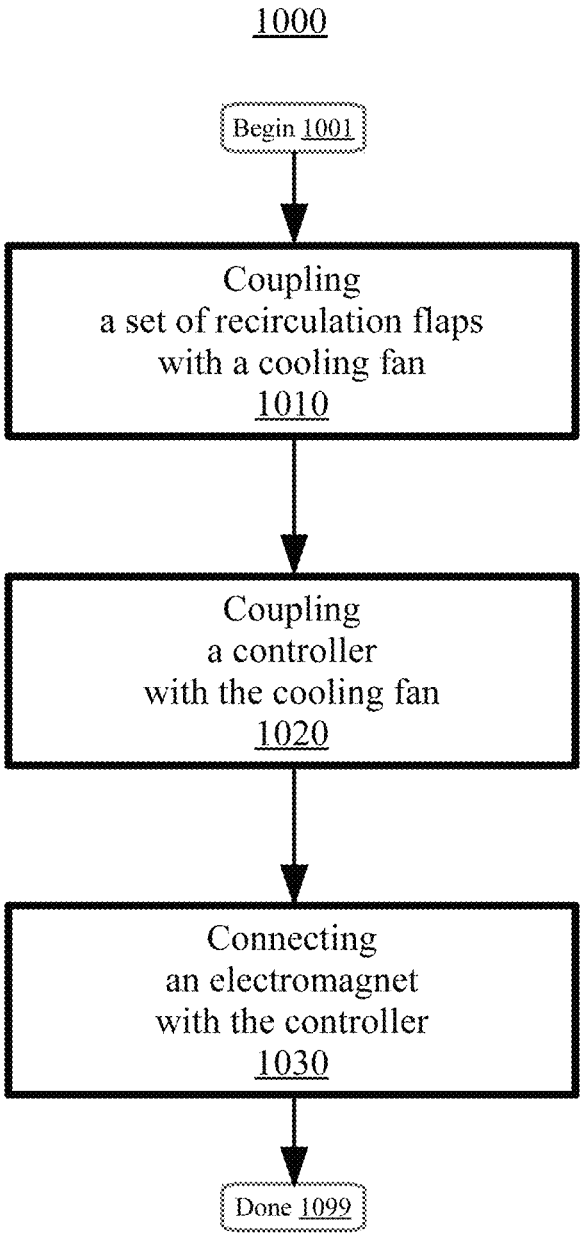
FIG. 10 is a flowchart illustrating a method for manufacturing a cooling apparatus, according to embodiments.

FIG. 10 is a flowchart illustrating a method 1000 for manufacturing/structuring/constructing/developing a cooling apparatus, according to embodiments. The method may begin at block 1001. At block 1010, a set of recirculation flaps is coupled with a cooling fan. In embodiments, airflow is substantially unimpeded (e.g., lack of a measurable impedance by a commercial-off-the-shelf device which would negatively impact the system) with respect to the set of recirculation flaps coupled with the cooling fan. At least one recirculation flap has a ferrous material. In various embodiments, the set of recirculation flaps is arranged in an open position in response to air pressure from the cooling fan, and is arranged in a closed position in response to substantially no air pressure (e.g., effectively or nearly zero) from the cooling fan. Accordingly, the closed position may allow substantially no airflow (to prevent reverse airflow through the cooling fan).

At block 1020, a controller is coupled with the cooling fan. The controller indicates a set of indicated positions for the set of recirculation flaps based on a tachometer value. In embodiments, the controller includes both a fan speed controller and a recirculation flap controller. The fan speed controller may configure a fan speed which correlates with the tachometer value. The recirculation flap controller may arrange the set of recirculation flaps in an open position when the tachometer value exceeds a threshold and in a closed position when the tachometer value does not exceed the threshold.

At block 1030, an electromagnet is connected with the controller to position the set of recirculation flaps in the set of indicated positions using the ferrous material. In embodiments, the electromagnet includes a solenoid. In various embodiments, the electromagnet engages the ferrous material to arrange the set of recirculation flaps in an open position. In certain embodiments, the electromagnet maintains the set of recirculation flaps in the open position without use of air pressure from the cooling fan. In various embodiments, a permanent magnet neighbors the electromagnet to position the set of recirculation flaps in the set of indicated positions using the ferrous material in conjunction with the electromagnet. In certain embodiments, the electromagnet disengages the ferrous material from the permanent magnet to arrange the set of recirculation flaps in a closed position.

The method may conclude at block 1099. Aspects of the disclosure may have performance or efficiency benefits (e.g., airflow impedance, power consumption). In embodiments, the electromagnet uses less than 0.1 watts to position the set of recirculation flaps. For example, the electromagnet may use less than 0.1 watts to position the set of recirculation flaps when a fan size is 80×80 millimeters. In various embodiments, the electromagnet can use less than two percent (2%) of a cooling fan power to position the set of recirculation flaps (e.g., when the fan size is greater than 38 millimeters). As such, the electromagnet power may be negligible in comparison to the (maximum) power of the cooling fan.

In the foregoing, reference is made to various embodiments. It should be understood, however, that this disclosure is not limited to the specifically described embodiments. Instead, any combination of the described features and elements, whether related to different embodiments or not, is contemplated to implement and practice this disclosure. Many modifications and variations may be apparent to those of ordinary skill in the art without departing from the scope and spirit of the described embodiments.

The terminology used herein is for the purpose of describing particular embodiments only and is not intended to be limiting of the various embodiments. As used herein, the singular forms "a," "an," and "the" are intended to include the plural forms as well, unless the context clearly indicates otherwise. "Set of," "group of," "bunch of," etc. are intended to include one or more. It will be further understood that the terms "includes" and/or "including," when used in this specification, specify the presence of the stated features, integers, steps, operations, elements, and/or components, but do not preclude the presence or addition of one or more other features, integers, steps, operations, elements, components, and/or groups thereof. In the previous detailed description of exemplary embodiments of the various embodiments, reference was made to the accompanying drawings (where like numbers represent like elements), which form a part hereof, and in which is shown by way of illustration specific exemplary embodiments in which the various embodiments may be practiced. These embodiments were described in sufficient detail to enable those skilled in the art to practice the embodiments, but other embodiments may be used and logical, mechanical, electrical, and other changes may be made without departing from the scope of the various embodiments. In the previous description, numerous specific details were set forth to provide a thorough understanding the various embodiments. But, the various embodiments may be practiced without these specific details. In other instances, well-known circuits, structures, and techniques have not been shown in detail in order not to obscure embodiments.

Furthermore, although embodiments of this disclosure may achieve advantages over other possible solutions or over the prior art, whether or not a particular advantage is achieved by a given embodiment is not limiting of this disclosure. Thus, the described aspects, features, embodiments, and advantages are merely illustrative and are not considered elements or limitations of the appended claims except where explicitly recited in a claim(s). Therefore, while the foregoing is directed to exemplary embodiments, other and further embodiments of the invention may be devised without departing from the basic scope thereof, and the scope thereof is determined by the claims that follow.

What is claimed is:

1. An apparatus comprising:

a set of recirculation flaps coupled with a cooling fan, wherein at least one recirculation flap has a ferrous material;

a controller coupled with the cooling fan, wherein the controller indicates a set of indicated positions for the set of recirculation flaps based on a tachometer value; and an electromagnet connected with the controller to position the set of recirculation flaps in the set of indicated positions using the ferrous material, wherein:

the electromagnet engages the ferrous material to arrange the set of recirculation flaps in an open position; and the electromagnet uses less than two percent (2%) of a cooling fan power to position the set of recirculation flaps.

2. The apparatus of claim 1, further comprising a permanent magnet which neighbors the electromagnet to position the set of recirculation flaps in the set of indicated positions using the ferrous material in conjunction with the electromagnet.

3. The apparatus of claim 2, wherein the electromagnet disengages the ferrous material from the permanent magnet to arrange the set of recirculation flaps in a closed position.

4. The apparatus of claim 1, wherein the electromagnet uses less than 0.1 watts to position the set of recirculation flaps.

5. The apparatus of claim 4, wherein a fan size is 80×80 millimeters.

6. The apparatus of claim 1, wherein the electromagnet includes a solenoid.

7. The apparatus of claim 1, wherein airflow is substantially unimpeded with respect to the set of recirculation flaps coupled with the cooling fan.

8. The apparatus of claim 1, wherein the set of recirculation flaps is arranged in:

an open position in response to air pressure from the cooling fan, and a closed position in response to substantially no air pressure from the cooling fan, wherein the closed position allows substantially no airflow to prevent reverse airflow through the cooling fan.

9. The apparatus of claim 1, wherein the controller includes:

a fan speed controller to configure a fan speed which correlates with the tachometer value; and a recirculation flap controller to arrange the set of recirculation flaps in an open position when the tachometer value exceeds a threshold and in a closed position when the tachometer value does not exceed the threshold.

10. The apparatus of claim 1, wherein the electromagnet maintains the set of recirculation flaps in the open position without use of air pressure from the cooling fan.

* * * * *